United States Patent [19]

Boyle

[11] Patent Number: 4,580,954

[45] Date of Patent: Apr. 8, 1986

[54] OSCILLATING-DEFLECTOR PUMP

[76] Inventor: Bede A. Boyle, Rural Bank Chambers, Corner Hunter & Bolton Sts., Newcastle, N.S.W., 2300, Australia

[21] Appl. No.: 610,471

[22] Filed: May 15, 1984

[30] Foreign Application Priority Data

May 23, 1983 [AU] Australia ..... PF9486

[51] Int. Cl.[4] ..... F04B 7/00; F04B 39/10

[52] U.S. Cl. ..... 417/517; 417/519; 417/532; 417/900

[58] Field of Search ..... 417/516, 517, 518, 519, 417/532, 900, 342, 347

[56] References Cited

U.S. PATENT DOCUMENTS

| | | | |
|---|---|---|---|
| 1,531,698 | 3/1925 | Janes | 417/532 |
| 2,384,783 | 9/1945 | Longenecker | 417/519 |
| 3,146,721 | 9/1964 | Schwing | 417/900 |
| 3,601,511 | 8/1971 | von Massenbach | 417/519 |
| 3,667,869 | 6/1972 | Schlecht | 417/900 |
| 3,749,525 | 7/1973 | Hooper et al. | 417/900 |
| 3,999,895 | 12/1976 | Boyle | 417/271 |

FOREIGN PATENT DOCUMENTS

| | | | |
|---|---|---|---|
| 451127 | 8/1949 | Italy | 417/900 |

*Primary Examiner*—Cornelius J. Husar
*Assistant Examiner*—Peter M. Cuomo
*Attorney, Agent, or Firm*—Stevens, Davis, Miller & Mosher

[57] ABSTRACT

A slurry pump having a pair of cylinders aligned one on either side of a centrally-disposed oscillating-deflector element; each cylinder has a housing in which are defined co-axial, registering hydraulic and slurry cylinder bores, and a piston rod having, at one end thereof a hydraulic piston head slidably movable within the hydraulic cylinder bore and having, at its other end a slurry piston head slidably movable within the slurry cylinder bore. The oscillating-deflector element has passageways enabling communication, alternately, between a slurry inlet conduit and a first one of the said two slurry cylinders, and between said slurry inlet conduit and a second one of the two slurry cylinders, the second slurry cylinder is in communication with a slurry discharge conduit when said slurry inlet conduit is in communication with said first slurry cylinder, and the first slurry cylinder is in communication with the slurry discharge conduit when the slurry inlet conduit is in communication with said second slurry cylinder. The oscillating-deflector element has an axis of rotation normal to the longitudinal, reciprocal axes of the hydraulic and slurry cylinder bores, and oscillates with an axial shaft, one end of which operates so as to oscillate the element and the other end of which carries a valve which controls selection of the direction of oscillation of the element.

2 Claims, 19 Drawing Figures

FIG. 1
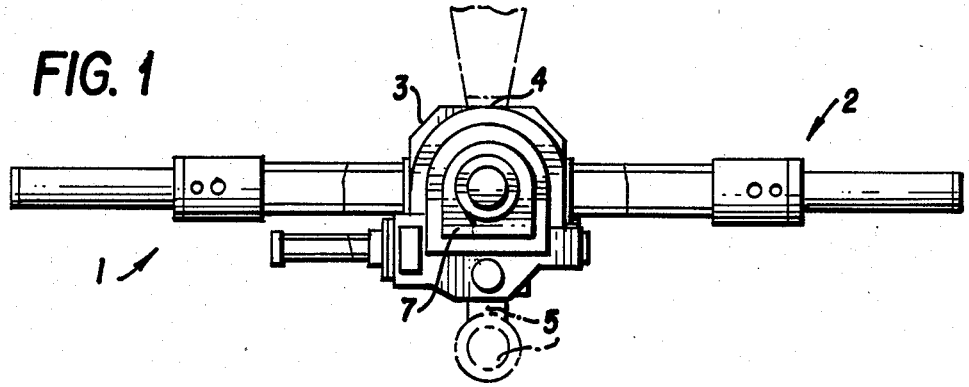
FIG. 2
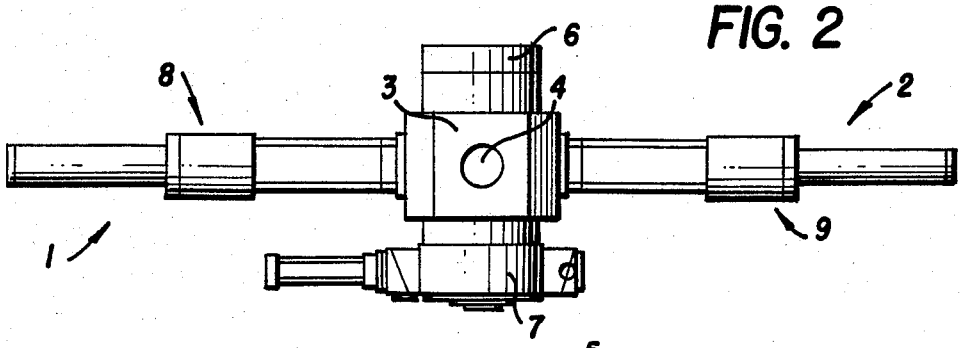
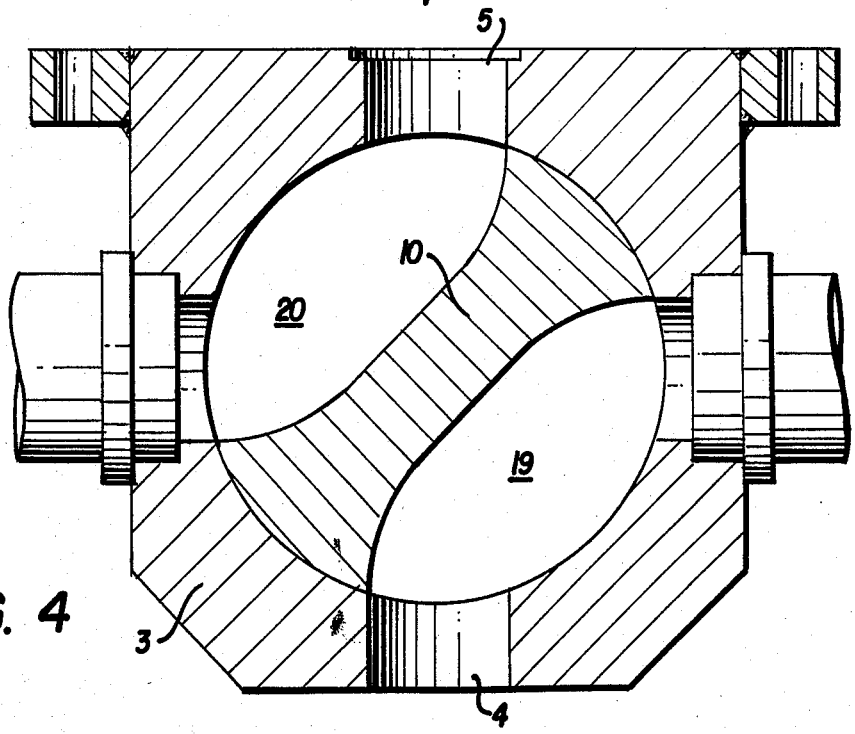
FIG. 4

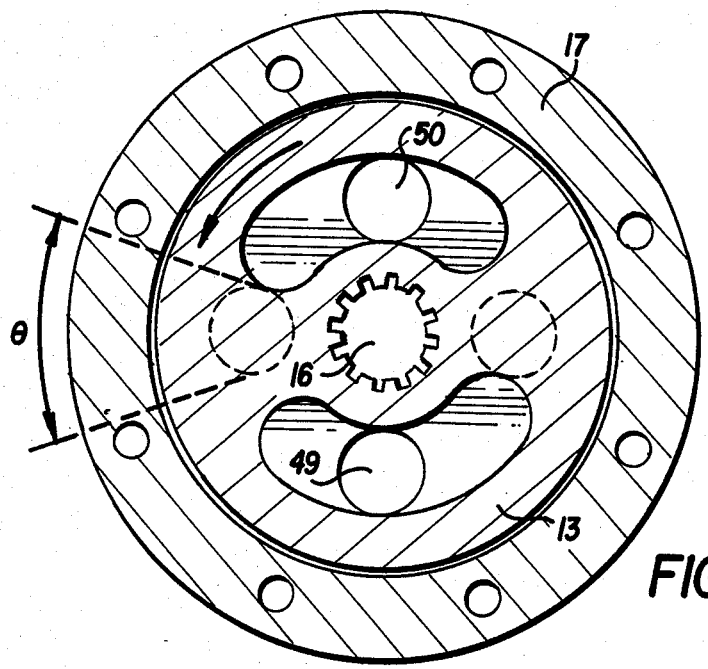
FIG. 8A
FIG. 8B
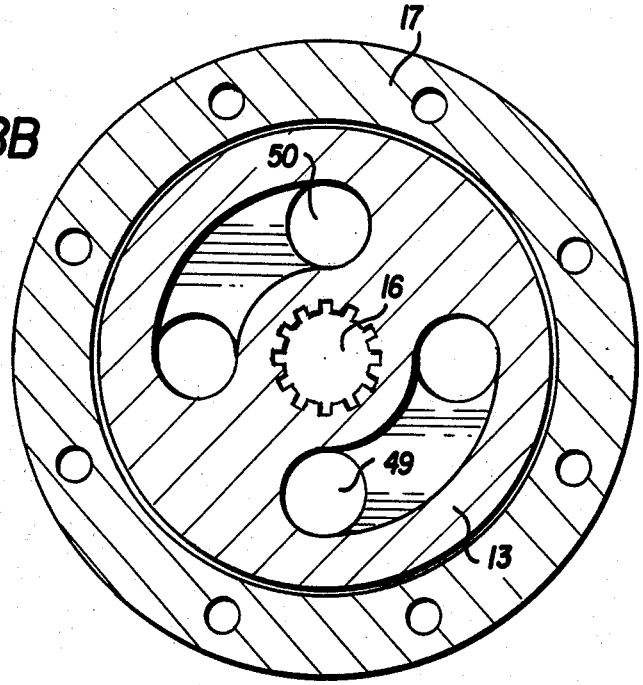

OSCILLATING-DEFLECTOR PUMP

This invention relates to pumps, and more particularly to pumps adapted for the movement of slurries or mixtures of liquids and granular solids for pipeline transportation.

For example, in one example of the invention described herein the pump is adapted to transport materials such as coal, iron ore, limestone, wood chips, fly ash, mineral process tailings and other particulate solid substances. In the transport of minerals especially, it is an advantage to mix such materials with water or some other suitable liquid to form a slurry because the fluid-like properties of the latter reduce the resistance of motion of solid materials when moving relative to a stationary boundary or pipe wall.

Positive displacement pumps for slurry pipelining of solid materials have developed largely because of mud pumping requirements in oilfield drilling. Many presently-used pumps for pipeline transportation over hundreds of miles are of crank-driven piston and ram design. Such pumps work directly on the slurry, or on some suitable liquid which contacts the slurry, in a chamber; or else the pumping liquid is separated by a diaphragm from the slurry in a chamber. Another known arrangement has chambers or hoppers in which the slurry is separated, by a ball-like element, from the pumped liquid.

In all these aforementioned prior art systems, pump cylinders and chambers are charged and discharged intermittently, and pumps are generally of duplex or triplex configuration to reduce fluctuations in flow rate, and usually a pneumatic damper is fitted to reduce pressure pulsations. In the chamber method, a sophisticated means of timing is necessary to control slurry discharge to the pipeline and hence reduce pressure fluctuations. Generally, positive displacement pumping arrangements require valves which can operate in slurry at a pressure of around 2000 p.s.i. The poppet type valve with elastic seating has widespread current use in these systems but is not immune to abrasion from slurry.

In U.S. Pat. No. 3,999,895 there is disclosed and claimed a rotating-barrel pump which has a plurality of aligned motor cylinders and pump cylinders in a rotating cylinder block, and corresponding inlet and outlet ports for driving fluid and for the pumped slurry.

Piston slurry pumps characteristically have some kind of valve device which acts to shear off the slurry on both the suction and discharge flows.

It is therefore an object of the present invention to provide a wear-resistant high pressure pump for the handling of, particularly, abrasive slurries and suspensions, and which eliminates the abovementioned problem of valve shear of the pressurized discharge product.

Thus, in accordance with the present invention there is provided an oscillating-deflector slurry pump comprising a pair of cylinder arrangements aligned one either side of a centrally-disposed oscillating-deflector element; each said cylinder arrangement being constituted by a housing in which are defined co-axial, registering hydraulic and slurry cylinder bores, and a piston rod having, at one end thereof, hydraulic piston head slidably movable within said hydraulic cylinder bore and having, at the other end thereof, a slurry piston head slidably movable within said slurry cylinder bore; said oscillating-deflector element having within it passageways enabling communication, alternately, between a slurry inlet conduit and a first one of the said two slurry cylinders, and between said slurry inlet conduit and a second one of the said two slurry cylinders, said second slurry cylinder being in communication with a slurry discharge conduit when said slurry inlet conduit is in communication with said first slurry cylinder, and said first slurry cylinder being in communication with said slurry discharge conduit when said slurry inlet conduit is in communication with said second slurry cylinder; and said oscillating-deflector element having an axis of rotation normal to the longitudinal, reciprocal axes of the hydraulic and slurry cylinder bores, and being adapted to oscillate with an axial shaft, one end of which operates so as to oscillate the said element and the other end of which carries valve means which controls selection of the direction of oscillation of the said element.

In order that the reader may gain a better understanding of the present invention, hereinafter will be described a preferred embodiment thereof, by way of example only, and with reference to the accompanying drawings in which:

FIG. 1 is a general side elevation of an oscillating-deflector slurry pump in accordance with the present invention;

FIG. 2 is a corresponding plan view;

FIG. 4 shows, somewhat simplistically, the location of the oscillating deflector element within its casing;

FIG. 8 shows the ported valve plate;

Figure 9A:
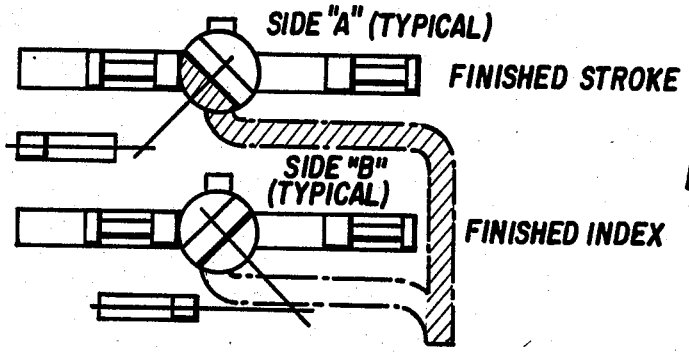
Figure 9B:
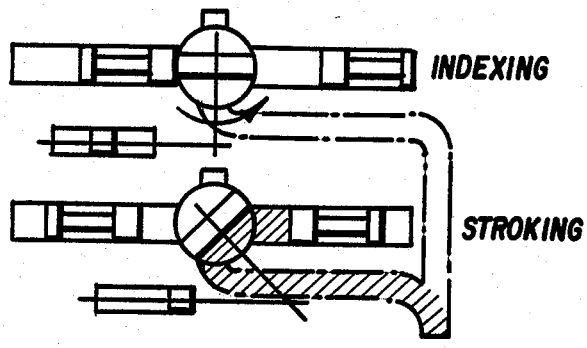
Figure 9C:
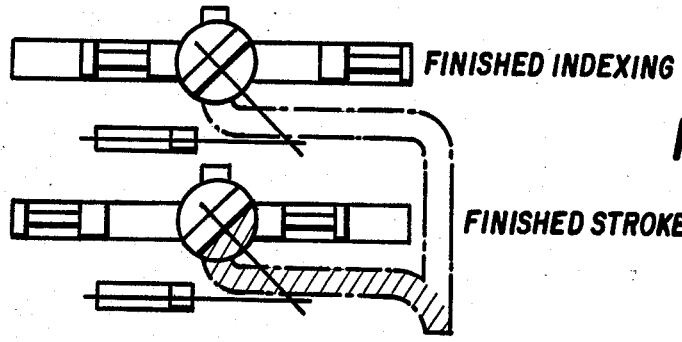
Figure 9D:
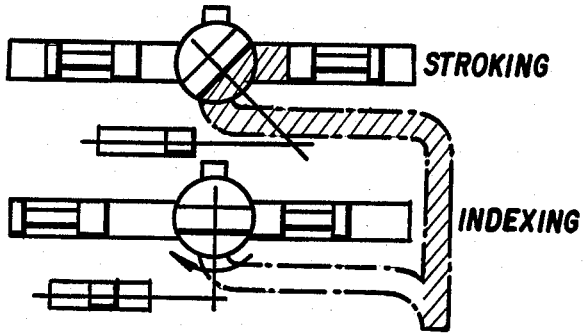
Figure 9E:
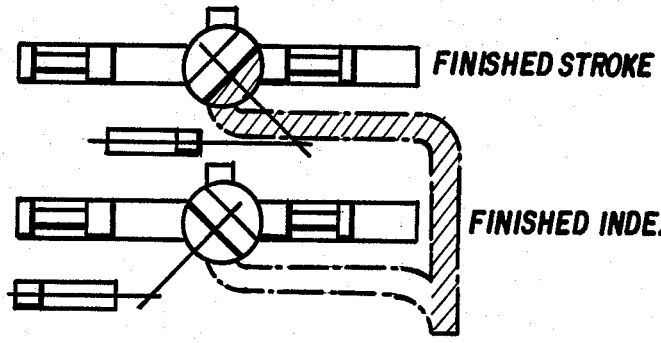
Figure 9F:
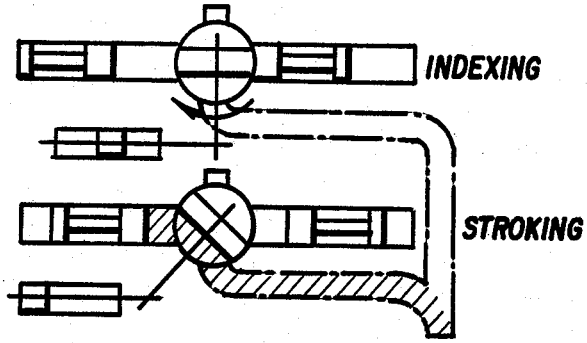
Figure 9G:
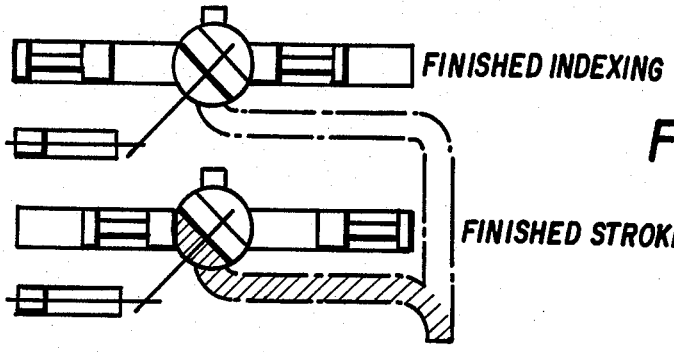
Figure 9H:
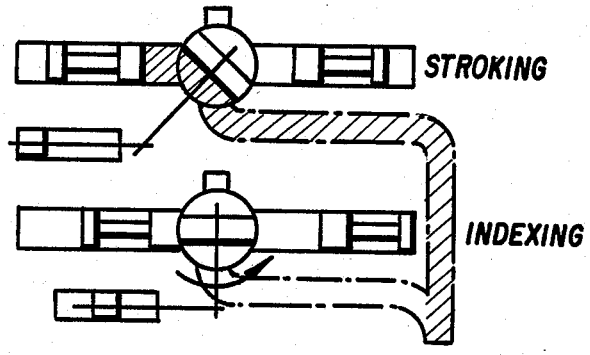
Figure 9I:
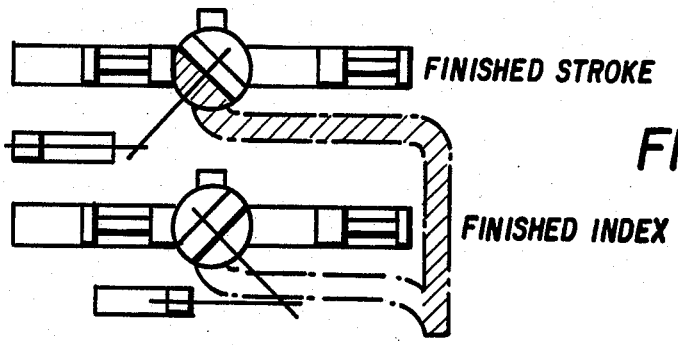
Figure 10:
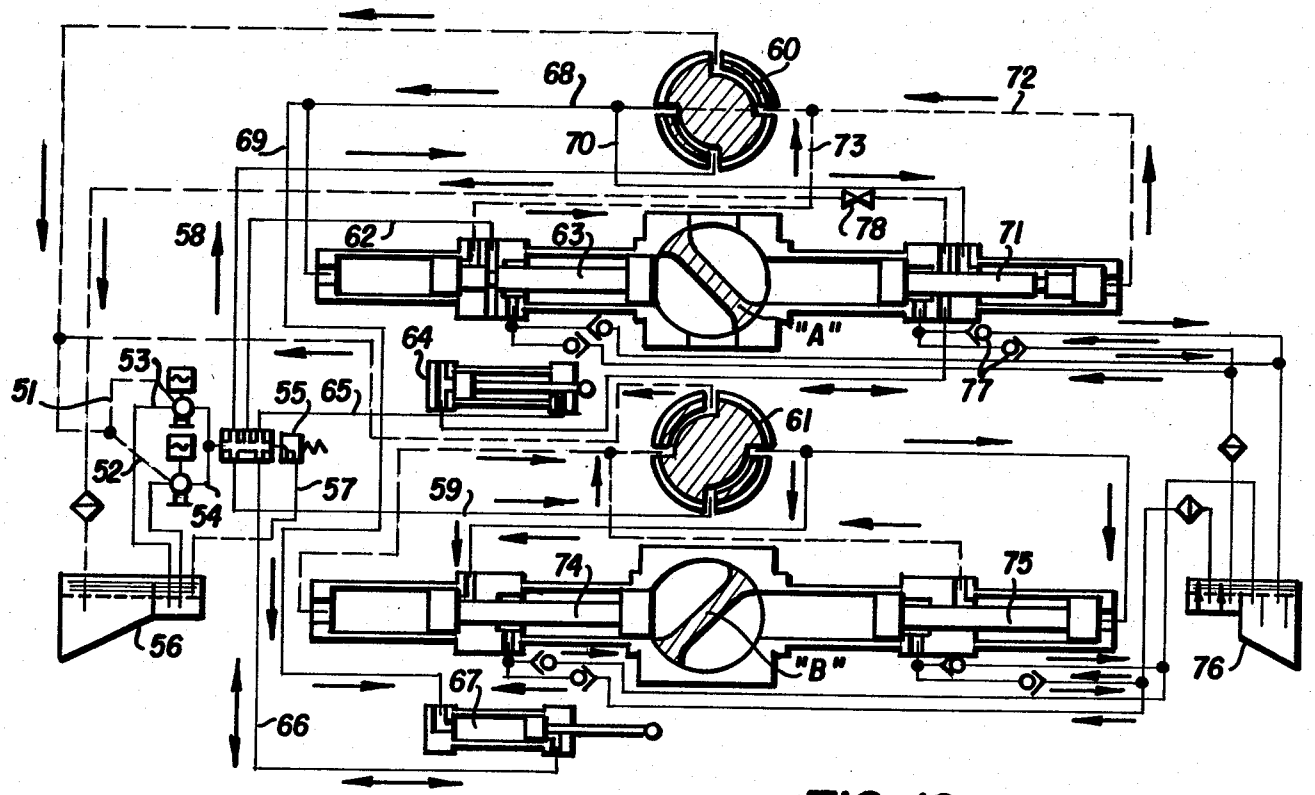

FIG. 9A to 9I constitute a sequence diagram for the operation of a two-pump assembly; and FIG. 10 is the hydraulic circuit required for the above assembly.

The drawings clearly show that the inventive pump includes a pair of cylinder arrangements 1 and 2 aligned one on either side of a centrally-disposed oscillating-deflector element accommodated within a housing 3 which has a slurry inlet conduit 4 and a slurry discharge conduit 5. In the generalized views of FIGS. 1 and 2 there can also be seen a housing 6 for the valve means and a further housing 7 for the reciprocating mechanism, both later to be described herein. Also later to be described herein are those portions of the cylinder arrangement which are circled and referenced 8 and 9.

Each cylinder arrangement is made up of a tubular housing in which are defined co-axial, registering hydraulic and slurry cylinder bores, which will better be seen and understood hereinafter with particular reference to FIGS. 5 and 6 of the drawings.

Figure 3:
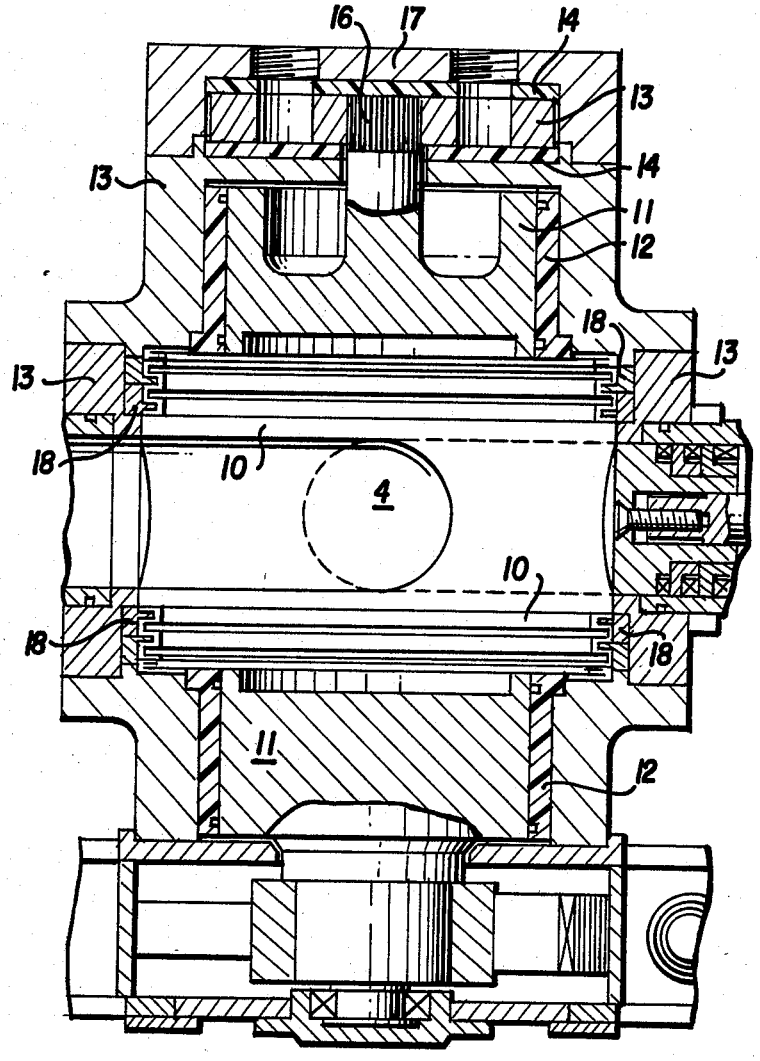
FIG. 3 is a horizontal cross-section.

FIG. 3 is a horizontal cross-section through the oscillating-deflector element and its housing 3, and illustrates the design detail of the components. Housing 3 accommodates an oscillating-deflector element 10 adapted to oscillate with an axial shaft 11 running in bearings 12. One end of axial shaft 11 carries a ported valve plate 13 adapted to control selection of the direction of oscillation of the oscillating-deflector element 10; valve plate 13 is faced on both sides by bearing plates 14 and 15. Valve plate 13 is rigidly affixed to the axial shaft 11 via a valve shaft 16; valve plate 13 and bearing plates 14 and 15 are covered by a stationary cover plate 17.

The other end of axial shaft 11 carries a reciprocating mechanism which operates so as to oscillate the deflector element.

The valve arrangement 13, 14, 15, 16 and 17 is shown in plan view in FIG. 8, to be described later herein, while the reciprocating mechanism will be hereinafter described with reference to FIG. 7.

FIG. 3 also shows the location of the "labyrinth" rings 18 which provide the sealing necessary to ensure a high pressure grease interface between the pumped slurry and the bearings; the said interface acts between the deflector and its housing.

FIG. 4 shows, somewhat simplistically, the geometry of the oscillating-deflector element within its casing or housing 3 which has, as was to be seen in FIG. 1, a slurry inlet conduit 4 and a slurry discharge port 5, Within housing 3 oscillates an oscillating-deflector element 10 (see FIG. 3, also) which has the configuration of a right cylinder, substantially solid in the main but having defined therein the two communicating passageways 19 and 20, each of the passageways having a circular cross-section and being of substantially arcuate form.

Figure 5:
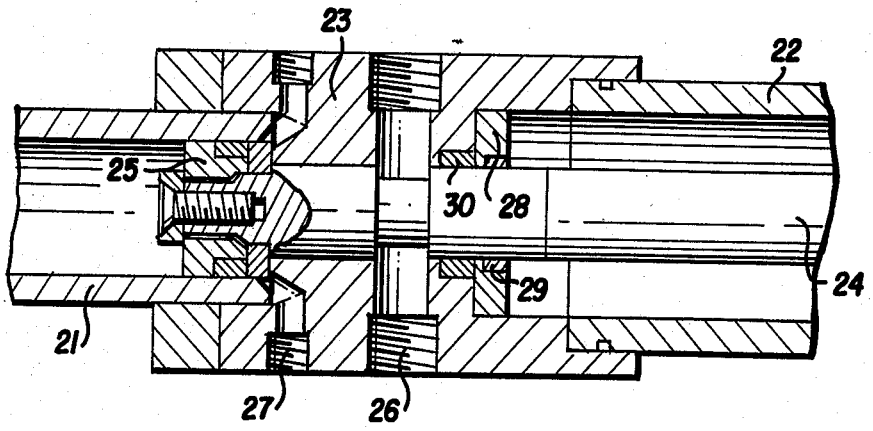
FIG. 5 is a vertical cross-section through one cylinder arrangement, circled and referenced "9" in FIG. 2.

FIG. 5 is a vertical cross-section through one cylinder arrangement as circled and referenced 9 in FIG. 2, illustrating the design details of these components. Cylinder arrangement 2 includes hydraulic cylinder 21 and a slurry cylinder 22 connected by a sleeve 23. Reciprocally movable through the two cylinders is a piston rod 24 having, at the end shown in FIG. 5, a hydraulic piston head 25. Sleeve 23 includes indexing cylinder ports 26 and cylinder return ports 27, while at the "sleeve end" of slurry cylinder 22 is a scraper ring 28 having a scraper ring seal 29, and a high pressure seal 30.

Figure 6:
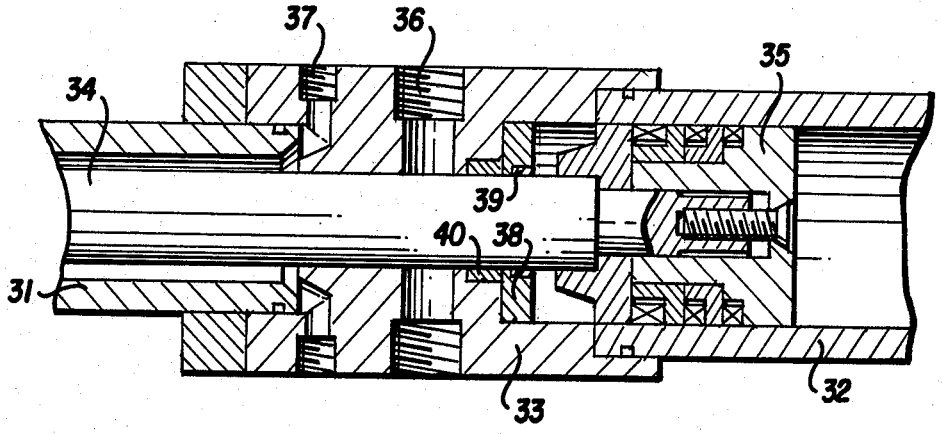
FIG. 6 is a similar vertical cross-section through the other cylinder arrangement, circled and referenced "8" in FIG. 2.

FIG. 6 is a vertical cross-section through the other cylinder arrangement as circled and referenced 8 in FIG. 2, illustrating the design details of these components. Cylinder arrangement 1 includes a hydraulic cylinder 31 and a slurry cylinder 32 connected by a sleeve 33. Reciprocally movable through the two cylinders is a piston rod 34 having, at the end shown in FIG. 6, a slurry piston head 35. Sleeve 33 includes indexing cylinder ports 36 and cylinder return ports 37, while at the "sleeve end" of slurry cylinder 32 is a scraper ring 38 having a scraper ring seal 39 and a high pressure seal 40.

Pressure applied to the cylinder return ports fills the annular spaces between the piston rods and the cylinder bores.

Now, considering together FIGS. 1 to 6, the reader will readily appreciate that oscillating deflector 10 enables communication to be made, alternately, between the slurry inlet conduit 4 and slurry cylinder 32, and between slurry inlet conduit 4 and slurry cylinder 22; slurry cylinder 22 being in communication with slurry discharge conduit 5 when slurry inlet 4 is in communication with slurry cylinder 32, and slurry cylinder 32 being in communication with slurry discharge conduit 5 when slurry inlet conduit 4 is in communication with slurry cylinder 22.

It should be noted that the hydraulic cylinders may be of the same, or smaller, or larger diameter than the slurry cylinders depending on designed pressure and flow requirements. Generally, however, the hydraulic cylinders will be of diameter smaller than that of the slurry cylinders to give a volumetric efficiency advantage.

The components of the pump which come in contact with the slurry are:

slurry piston head
slurry cylinder
centre deflector, and
deflector housing.

One possible desirable material selection is as follows:

The slurry piston head is of nickel-chromium-molybdenum steel case-hardened and ground to give a neat fit in the slurry cylinder, and is fitted with close-grained grey cast iron piston rings running in a chromed and honed 1% chromium-molybdenum steel slurry cylinder, with a back flushing soluble oil and water fluid mix.

The centre deflector and deflector housing is of a 1% chromium-molybdenum steel with a high carbon level. The mating surfaces are case-hardened and provided (by means of the labyrinths) with a water repellant grease interface.

Axial shaft 11, deflector element 10, valve shaft 16 and valve plate 13 are constructed as an integral unit and as such the indexing of the deflector element provides corresponding indexing of the valve plate.

Figure 7:
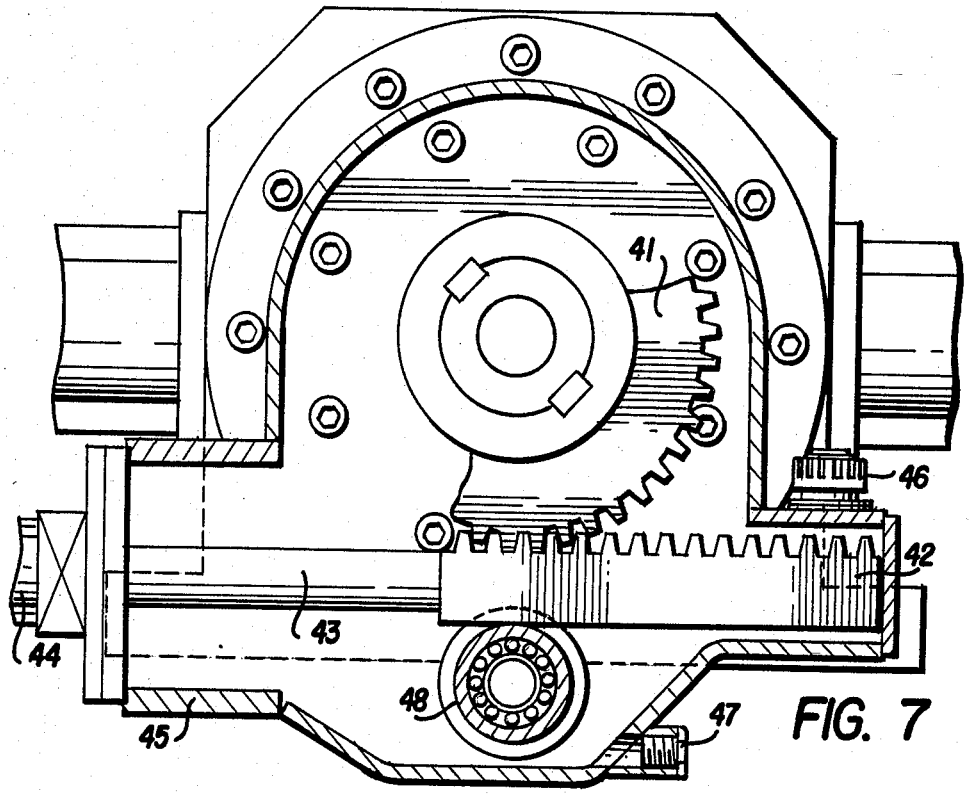
FIG. 7 shows how the reciprocating mechanism is arranged.

FIG. 7 shows the reciprocating mechanism. The said one end of axial shaft 11 carries a gear quadrant 41 which co-acts with a gear rack 42 affixed to a piston rod 43 working in an indexing cylinder 44. The reciprocating mechanism housing 45 is provided with a conventional filler/breather 46, drain plug 47 and adjustment shaft 48.

FIG. 8 includes views of two positions of the valve means and should be perused with reference to FIG. 3. FIG. 8 represents a plan view showing valve plate 13 in the two positions, valve shaft 16 and valve cover plate 17. Also shown are high pressure and return ports 49 and 50 respectively.

FIGS. 9A to 9I constitute a sequence diagram or flow chart for the operation of a dual pump assembly which will result in full bore continuous discharge of pumped product. This dual pump assembly is termed a "duplex" pump and comprises two single or "simplex" pumps, as hereinbefore described with reference to FIGS. 1 to 8. The duplex pump comprises the two simplex pumps here designated "SIDE A" and "SIDE B" (see FIG. 9A). Needless to say, more than just two pumps may be employed to constitute what may aptly be termed a "multiplex" pump assembly.

FIG. 9A represents a starting configuration of pump pistons and centre deflectors. This position depicts the moment when pump side A has just completed a piston stroking sequence where both left hand and right hand pistons stroked left to right, the left hand piston executing a discharge stroke and the right hand piston executing a suction stroke.

Simultaneously the pump side B executed an indexing sequence with the centre deflector rotating 90 anticlockwise to the configuration shown in position 1.

FIG. 9B shows the next operation which involves pump side A indexing the centre deflector 90 anticlockwise (with both pistons stationary) whilst simultaneously, pump side B executes a piston stroking sequence where both left hand and right hand pistons stroke right to left, the left hand piston executing a suction stroke and the right hand piston executing a discharge stroke.

FIG. 9C shows the completion of this sequence with pump side A fully indexed and pump side B fully stroked.

FIG. 9D shows the next operation with pump side A executing a piston stroking sequence with both left hand and right hand pistons stroking right to left, whilst simultaneously pump side B executes an indexing sequence in a clockwise rotation (with both pistons stationary).

FIG. 9E depicts the completion of this operation.

FIG. 9F depicts the next operation where pump side A indexes clockwise (with both pistons stationary) whilst pump side B executes a stroking sequence with both left hand and right hand pistons stroking left to right.

FIG. 9G depicts the completion of this operation.

FIG. 9H depicts the next operation with pump side A executing a stroking sequence with both left hand and right hand pistons stroking left to right, whilst pump side B executes an indexing sequence in an anti-clockwise rotation.

FIG. 9I depicts the completion of this operation and hence a complete duplex pump cycle, with each of the four piston rods having executed one suction (inlet) stroke and one discharge stroke.

FIG. 10 represents a duplex oscillating-deflector pump hydraulic operating circuit.

An electric motor or internal combustion engine 51 and 52 is arranged to drive hydraulic pumps 53 and 54, each discharging to the manifold 55. Two motor/pump assemblies are shown to indicate that the manifold 55 may be supplied by one or more hydraulic units. An oil tank 56 supplies oil to the hydraulic pumps 53 and 54 shown.

The manifold 55 has six outlet lines which are open to hydraulic pump supply pressure at all times. Line 57 contains a pressure relief valve which affords protection against excess pressure to the complete hydraulic circuit.

Lines 58 and 59 feed the underside or pressure ports in the valves 60 and 61, respectively. Line 62 feeds the indexing cylinder 64 port shown in FIG. 5 and in FIG. 6. When in the open position, the indexing cylinder port at piston 63 allows flow of hydraulic oil to stroke the indexing cylinder 64 left to right, indexing the centre deflector "A" anti-clockwise.

Lines 65 and 66 feed the cylinder rod ends of indexing cylinder 64 and indexing cylinder 67 respectively, and are pressurized at all times. Both indexing cylinders are regenerative in that they supply the "rod end" volume back into the supply circuit when stroking left to right, thereby requiring the same volumetric supply rate for stroking in either direction (because they are so sized that the piston area is twice the cylinder rod area).

When centre deflector "A" reaches the position shown, valve 60 opens lines 68, 69 and 70 to hydraulic pump supply whereby line 68 causes piston 63 to stroke left to right to execute a discharge stroke, line 70 causes piston 71 to stroke left to right to execute a suction stroke, and line 69 causes indexing cylinder 67 to stroke left to right executing anti-clockwise indexing of centre deflector "B". Pistons 63 and 71 are allowed to stroke because valve 70 simultaneously opens lines 72 and 73, which action allows them to exhaust to the oil tank 56.

When piston 63 full strokes and reaches the position shown, it opens line 62 through the indexing cylinder port which causes indexing cylinder 64 to stroke left to right, thereby indexing centre deflector "A" anti-clockwise. Simultaneously with the indexing cylinder 64 stroking left to right valve 61 causes pistons 74 and 75 to stroke right to left, thereby executing a suction and discharge stroke respectively.

Completion of centre deflector "A" anti-clockwise indexing causes valve 60 to pressurize lines 72 and 73 and exhaust lines 68, 69 and 70. This causes pistons 63 and 71 to stroke right to left and simultaneously causes indexing cylinder 67 to index centre deflector "B" clockwise. When pistons 63 and 71 are fully stroked right to left, piston 63 closes its indexing cylinder port and piston 71 opens its indexing cylinder port to the oil tank which causes indexing cylinder 63 to stroke right to left thereby indexing centre deflector "B" clockwise and hence continuing the operating sequence.

In comparison with some currently available piston type slurry pumps, the present invention does not require any electronic or pressure sensing valves, but rather uses the location of the slot in the piston rods of pistons 63 and 71 to ensure full piston stroking before the next indexing operation.

The flush fluid tank 76 provides flushing fluid to the annulus formed by the piston rod and slurry cylinder (immediately behind the slurry piston head). This fluid is circulated by the reciprocation of the slurry pistons, and the "check" valves 77 shown in the circuits. The flushing fluid forms a desirable barrier between the driving hydraulic oil supply and any leakage of fluid from the pumped product.

Turning back once more to FIG. 4, shown is one of the two positions which the deflector element holds while the pistons stroke, in this case from right to left. The fact that the centre deflector is stationary during piston stroking leads to one advantage of the pump—that is, that there are registering, uninterrupted full bore areas open to suction and discharge, thereby not offering any restriction to slurry flow into or out of the pump.

The fact that the centre deflector indexes 90° clockwise from the position shown, constitutes another advantage of the pump, that is, that no part of the pump is required to shear through the pressurized line of discharge slurry, as the poppet valves or their equivalent are required to do in other known pumps.

As regards FIG. 8, this illustrates the valve plate 13 in two positions, the one on the left-hand side showing valve plate 13 in fully indexed position, and the one on the right-hand side showing the valve plate rotating anti-clockwise, at the position where it is just opening to the cylinder ports. This position shows that, owing to the port lead angle 0, the cylinders of one pump side are pressurized momentarily prior to the completion of the indexing sequence. Similarly the slots in the piston rods open the indexing cylinder ports momentarily before piston full stroke.

The hydraulic lines to the indexing cylinders are sized, or a variable restrictor 78 is fitted (FIG. 10), to ensure the condition that the same time is required to full stroke an indexing cylinder as is required to full stroke a pump piston. Thus for example, the same time is taken for valve 60 to index, as for pistons 74 and 75 to full stroke. This feature, combined with the valve overlaps and full bore slurry port openings, described above, will lead to a full bore, pulse free, continuous discharge.

Thus the inventive pump sucks in material through the full bore, valveless opening to a free cylinder. After 90° indexing of the oscillating deflector the sucked-in slurry is pushed directly into the delivery line, each cylinder operating in a controlled sequence of suction and discharge. Since the suction and discharge openings are constant, by virtue of the passageways of the oscillating deflector cylinder, there can be no slurry shearing troubles.

The above-described pump will be seen to require very little maintenance and be suitable for the pumping of a wide variety of products. Moreover, the pump cannot "short stroke" because the full stroke must be achieved if the deflection of the control element is to occur at all.

The following list summarises some of the advantages of the presently inventive pump:

1. Pulse free
2. No electronic or pressure sensitive valves
3. Full line suction and discharge openings
4. No shearing of compressed pressurised discharge slurry
5. Valve overlaps to give continous flow
6. Sizing hydraulic supply lines to give indexing in same time as piston stroking.

From the abovegoing, the reader will readily appreciate that oscillating-deflector pumps constructed in accordance with the present invention present the public with a new or much-improved article or, at the very least, offer to it a useful and most attractive choice.

The claims defining the invention are as follows:

I claim:

1. An oscillating-deflector slurry pump comprising:

a pair of cylinder assemblies coaxially aligned one on either side of a centrally-disposed oscillating-deflector element;

each said cylinder assembly having a housing, in which are defined registering coaxial hydraulic and slurry cylinder bores, and a piston rod having, at one end thereof, a hydraulic piston head slidably movable within said hydraulic cylinder bore and having, at the other end thereof, a slurry piston head slidably movable within said slurry cylinder bore;

said oscillating-deflector element being a substantially solid cylinder having an axis of rotation normal to the longitudinal, reciprocal axes of said hydraulic cylinder and slurry cylinder bores, and having defined therein two arcuately-formed communication passageways, each communication passageway opening being normal to an adjacent communication passageway opening;

said oscillating-deflector element oscillates together with an axial shaft, one end of which operates so as to oscillate the said element and the other end of which carries valve means which controls selection of the direction of oscillation of the said element;

the movement of said oscillating-deflector element being by means of a gear quadrant carried by said one end of said axial shaft and which is connected to operate said shaft via a reciprocating piston rod affixed to a co-acting gear rack and working in an indexing cylinder, and wherein said other end of said axial shaft carries a ported valve plate having means to control the said selection of the direction of oscillation of the said element;

said two passageways in said oscillating-deflector element enabling communication, alternately, in a first position, between a slurry inlet conduit and a first one of the said slurry cylinder bores and, in a second position, between said slurry inlet conduit and a second one of the said slurry cylinder bores;

said second slurry cylinder bore being in communication with a slurry discharge conduit when said slurry inlet conduit is in communication with said first slurry cylinder bore, in said first position;

said first slurry cylinder bore being in communication with said slurry discharge conduit when said slurry inlet conduit is in communication with said second slurry cylinder bore, in said second position; and the oscillating-deflector element remaining stationary, during piston stroking, alternately in said two positions, so that uninterrupted, registered full bore areas are open to suction and discharge with minimum resistance being offered to slurry flow into and out of the slurry pump, thus ensuring pulsefree continuous discharge of slurry.

2. An oscillating-deflector slurry pump comprising:

a pair of cylinder assemblies coaxially aligned one on either side of a centrally-disposed oscillating-deflector element;

each said cylinder assembly having a housing, in which are defined registering coaxial hydraulic cylinder and slurry cylinder bores, and a piston rod having, at one end thereof, a hydraulic piston head slidably movable with said hydraulic cylinder bore and, at the other end thereof, a slurry piston head slidably movable with said slurry cylinder bore;

said oscillating-deflector element being a substantially solid cylinder having an axis of rotation normal to the longitudinal reciprocal axes of said hydraulic cylinder and slurry cylinder bores, and having defined therein two arcuate communication passageways, each communication passageway opening being at right angles to each adjacent passageway opening;

said oscillating-deflector element being mounted upon an axial shaft;

means for causing oscillating motion of the said element including a gear quadrant carried by one end of said axial shaft and operating the latter via a reciprocating piston rod affixed to a co-acting gear rack and working within an indexing cylinder, the other end of said axial shaft carrying a ported valve plate which controls selection of the direction of oscillation of the said element;

said two passageways in said oscillating-deflector element enabling communication, alternately, in a first position, between a slurry inlet conduit and a first one of the said slurry cylinder bores and, in a second position, between said slurry inlet conduit and a second one of the said slurry cylinder bores;

said second slurry cylinder bore being in communication with a slurry discharge conduit when said slurry inlet conduit is in communication with said first slurry cylinder bore, in said first position;

said first slurry cylinder bore being in communication with said slurry discharge conduit when said slurry inlet conduit is in communication with said second slurry cylinder bore, in said second position;

the oscillating-deflector element remaining stationary, during piston stroking, alternately in said two positions, so that there are uninterrupted registering full bore areas open to suction and discharge, no resistance being offered to slurry flow into and out of the slurry pump; and a variable restrictor installed in a hydraulic line to said indexing cylinder so that the same time is required to full stroke said indexing cylinder as is required to full stroke a hydraulic cylinder bore, thus ensuring full-bore pulse-free, continuous discharge of slurry.

* * * * *